United States Patent [19]

Odawara et al.

[11] 4,157,267

[45] Jun. 5, 1979

[54] CONTINUOUS SEPARATION OF FRUCTOSE FROM A MIXTURE OF SUGARS

[75] Inventors: Hiroyuki Odawara; Masaji Ohno; Toru Yamazaki, all of Kamakura; Masazumi Kanaoka, Tokyo, all of Japan

[73] Assignee: Toray Industries, Inc., Tokyo, Japan

[21] Appl. No.: 826,640

[22] Filed: Aug. 22, 1977

[30] Foreign Application Priority Data

Aug. 24, 1976 [JP] Japan ..... 51/100151

[51] Int. Cl.[2] ..... C13K 1/00; C13K 3/00; C13K 11/00

[52] U.S. Cl. ..... 127/46 A; 127/46 R; 210/31 C

[58] Field of Search ..... 127/46 R, 46 A, 46 B; 210/31 C

[56] References Cited

U.S. PATENT DOCUMENTS 3,761,533 9/1973 Otani ..... 260/674 SA 4,014,711 3/1977 Odawara ..... 127/46 B

*Primary Examiner*—Sidney Marantz

*Attorney, Agent, or Firm*—Finnegan, Henderson, Farabow & Garrett

[57] ABSTRACT

A process for continuously separating, in liquid phase, fructose from a liquid feed mixture of sugars containing essentially fructose and glucose by contact with a solid sorbent of zeolite. The process utilizes a simulated countercurrent flow system wherein a liquid stream flows through serially and circularly interconnected desorption, rectification and sorption zones each zone being divided into a plurality of sections. In the zones water as desorbent is introduced into the desorption zone, the liquid feed mixture of sugars is introduced into the sorption zone, a desorption effluent is withdrawn from the desorption zone and a raffinate effluent is withdrawn from the sorption zone, and all of the points of introduction and withdrawal of the liquids are simultaneously shifted, one section at a time at predetermined intervals of time, in a downstream direction.

3 Claims, 6 Drawing Figures

| Fig. 3A | Fig. 3B |
|---|---|

CONTINUOUS SEPARATION OF FRUCTOSE FROM A MIXTURE OF SUGARS

The present invention relates to a process for continuously separating fructose from a mixture of sugars containing fructose, wherein certain solid sorbents or adsorbents are used as separating media. Fructose is the sweetest of all the sugars present in nature and has been known to be useful dietically as the most ideal sugar. However, no economical method of manufacturing fructose has been made available at present. Fructose, consequently, has been an expensive commodity and has found only limited use as a high-grade sweetener.

Examples of the presently used methods of manufacturing fructose are: (1) separating fructose from glucose by converting fructose into a calcium-fructose complex by treatment with calcium hydroxide or calcium chloride; (2) effecting the desired separation by using a cation-exchange resin bed, such as the calcium form (U.S. Pat. No. 3,044,904), the strontium form (U.S. Pat. No. 3,044,905), the silver form (U.S. Pat. No. 3,044,904) and the hydrazine form (U.S. Pat. No. 3,471,329); (3) effecting the desired separation by using anion-exchange resin beds, such as the borate form (U.S. Pat. No. 2,818,851) and the bisulfite form (U.S. Pat. No. 3,806,363), and; (4) other complicated methods (U.S. Pat. No. 3,050,444). The calcium method has been adopted for commercial operations and the bisulfite anion-exchange resin method is claimed to be promising. Nevertheless, the former method is batchwise in nature and not totally economical for large scale production, and the latter method requires a large amount of resin and is confronted with the serious problem of resin deterioration.

The two inventors of the present invention found that crystalline alumino-silcate or zeolite, which is generally used as a dehydration agent, sorbs fructose more strongly than other sugars such as glucose or other oligosaccharides, even in aqueous solution. Such selective sorption of fructose among sugars by zeolite is beyond the usual expectation, since fructose and glucose are isomers of the same molecular weight. Based on the above discovery, an economical method for separating fructose from a mixture of sugars containing fructose and glucose was proposed and was patented as a U.S. Pat. No. 4,014,711. The patented method comprises contacting an aqueous solution of the mixture of sugars with crystalline alumino-silicate having an average pore diameter greater than about 5A, desorbing the sorbed sugars with water and separating the fructose-rich fraction obtained. However the specification of the granted patent does not state any practical process for separation of fructose from glucose, based on the zeolite method, which can be advantageously employed in large scale commercial operation at a reduced cost.

An object of the present invention is to provide a process for continuously separating fructose from a mixture of sugars containing essentially fructose ang glucose, based upon the zeolite method, which process is very economical for large scale or industrial scale production.

The process of the present invention utilizes a simulated countercurrent flow system wherein liquid streams are allowed to flow through serially and circularly interconnected desportion, rectification and sorption zones. Each zone is divided into a plurality of serially interconnected sections. Each section is packed with solid sorbent particles of crystalline alumino-silicate. Water as desorbent is introduced into the first section of the desorption zone, and a liquid feed mixture containing essentially fructose and glucose is introduced into the first section of the sorption zone. A portion of a desorption effluent, containing fructose as a sorbate component and water as the desorbent, is withdrawn from the last section of the desorption zone, and a portion of a raffinate effluent, containing glucose as component sorbed less than fructose, is withdrawn from a point such that at least one section of the sorption zone remains downstream therefrom. All of the points of introducing and withdrawing liquid streams are simultaneously shifted one section at a time at stated intervals of time in a downstream direction, while maintaining the same order of continuity and the same spatial relationship between the points. As a result the liquid stream circulating through the loop of the sorbent packed sections contacts the sorbent particles in a simulated countercurrent manner.

In one embodiment of the present invention, the desorption effluent is prevented from directly flowing into the downstream rectification zone, and flows out from the last section of the desorption zone. One portion of the withdrawn desorption effluent as reflux is directly, or after being subjected to concentration such as evaporation or reverse osmosis separation, flown into the rectification zone. The other portion of the desorption effluent is subjected to concentration so that the sorbate product, i.e. fructose, is substantially separated from the excess desorbent of water.

In another embodiment of the present invention, one portion of the desorption effluent is directly flown into the downstream rectification zone as a circulating stream, while the other portion of the desorption effluent is withdrawn from the desorption zone and is subjected to evaporation, so that sorbate product is substantially separated from the excess desorbent.

A sorption-separation system of the present invention employs solid particles of crystalline alumino-silicate or zeolite as sorbent capable of selectively sorbing fructose. A liquid feed mixture essentially containing fructose and glucose is continuously separated into a sorbate component of fructose as a product and raffinate components containing glucose in the sorption-separation process.

Figure 1:
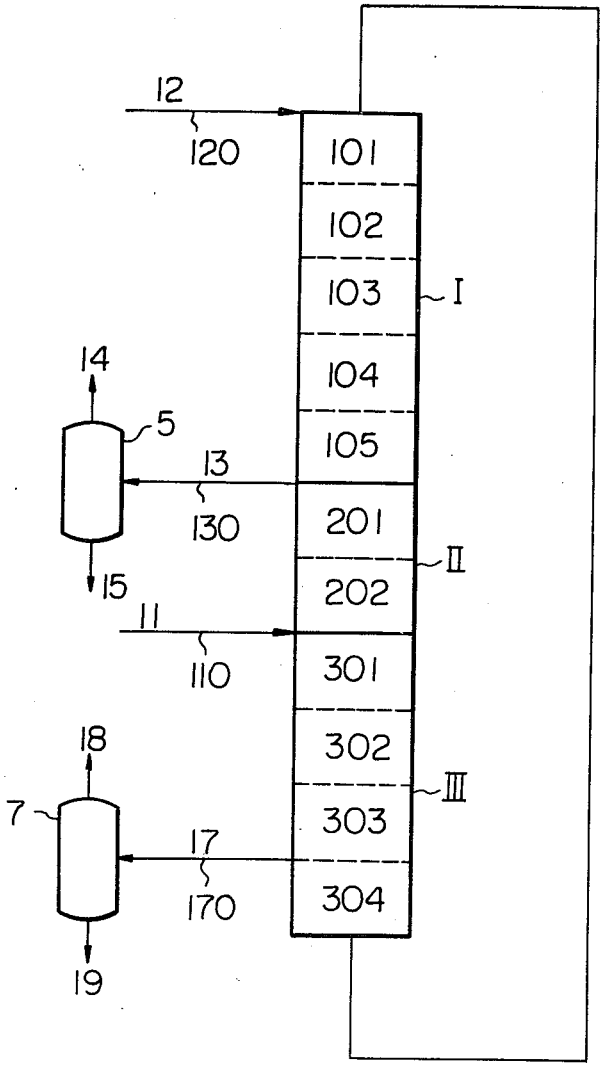
FIG. 1 shows one preferable cycle mode of the sorption-separation process in accordance with the present invention.
Figure 2:
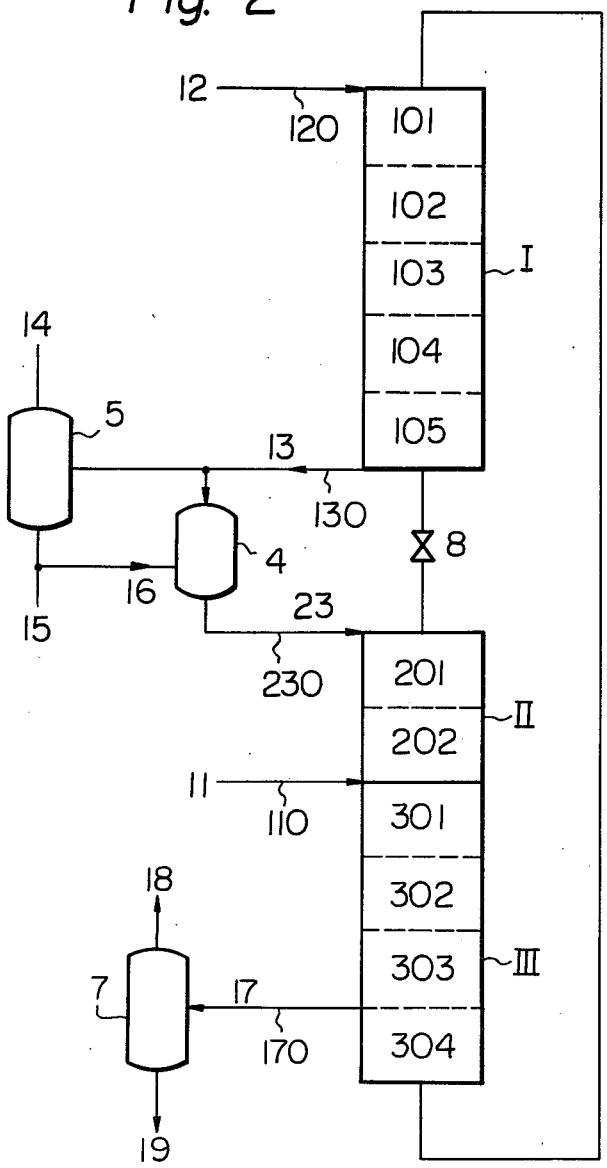
FIG. 2 shows another preferable cycle mode of the sorption-separation system according to the present invention.

Referring to FIGS. 1 and 2, the sorption-separation system involves columns charged with the solid sorbent particles of zeolite. The columns are divided into three zones: desorption zone I, rectification zone II and sorption zone III. These zones are serially and circularly interconnected in order. Each zone is composed of a plurality serially interconnected sections in the flow direction of liquid streams.

In the desorption zone I, a sorbate component or fructose selectively sorbed onto the solid sorbent particles is desorbed by contact with a desorbent stream of water. In the rectification zone 2, countercurrent contact between the stream of a desorbent effluent and a simulated flow of the component sorbed outs the solid sorbent particles is effected to maximize the purity of the sorbate product. In the sorption zone III, separation of the liquid feed mixture takes place by selective sorption of the sorbate component of the feed mixture onto the solid sorbent particles.

In the cycle mode shown in FIG. 1 water as desorbent 12 flows into the desorption zone I through an inlet of the first section 101 of the zone, while one portion of a liquid mixture 13 of desorbent and sorbate (the mixture is referred to as desorption effluent) is withdrawn through an outlet of the last section 105 of the desorption zone I and flows into an evaporator 5. In the evaporator 5 the desorption effluent is separated into both desorbent 14 and a concentrated aqueous solution of sorbate component 15. The desorbent 14 is circulated for re-use. The sorbate component 15 is withdrawn from the system as a product.

In the other cycle mode shown in FIG. 2, desorbent 12 flows into the desorption zone I through an inlet of the first section 101 of the zone, while the entire desorption effluent is prevented from directly flowing into the rectification zone II by a valve 8 and is withdrawn through an outlet of the desorption zone I. The withdrawn effluent flows into an evaporator 5, wherein the desorption effluent is separated into both desorbent 14 and a concentrated aqueous solution of sorbate component. The desorbent 14 is circulated for re-use. One portion of the aqueous solution 15 is withdrawn from the system as a product and the other portion 16 as reflux flows through the resorvoir 4 into the top section 201 of the rectification zone II.

In another reflux mode, one portion of the withdrawn effluent 13 flows into the evaporator and is concentrated there. The concentrated aqueous solution is withdrawn from system as a product 15. The other portion of the withdrawn effluent 13 flows directly through the resorvoir 4 into the top section 201 of the rectification zone II.

In both of the above described cycle modes, a liquid feed mixture of sugars, comprising fructose as sorbate component and glucose as raffinate component, flows through an inlet positioned between both the rectification and sorption zones II and III into the sorption zone III. A liquid mixture 17 comprising the desorbent and raffinate components or less sorbed component such as glucose (which mixture is referred to as raffinate effluent), is withdrawn from a point such that at least one section of the sorption zone III remains downstream therefrom. The withdrawn raffinate effluent is fed into an evaporator 7, where it is separated into desorbent 18 and raffinate 19 which is a concentrated aqueous solution of glucose. The separated desorbent 18 is circulated for re-use and the concentrated aqueous solution of glucose 19 is withdrawn out of the system.

The number of the sections existing downstream from the withdrawal point of raffinate effluent 17 in the sorption zone III are determined as follows. The entire length of the sections from the withdrawal point to the bottom of the last section 304 in the sorption zone III is such that a concentration of glucose contained in the stream flowing down through these sections reaches approximately zero at the bottom of the last section 304. Thus, the stream substantially containing no glucose is directly and continuously introduced into the desorption zone I. As a result, the sorbate product is prevented from being contaminated with the raffinate.

In both of the above described cycle modes, the top sections 101, 201, 301 of the desorption, rectification and sorption zones I, II and III, are simultaneously transferred to the bottoms of the sorption, desorption and rectification zones III, I and II, respectively, at predetermined intervals of time. The transfer is effected by shifting all of the points of introducing and withdrawing all of the liquid streams (12, 13, 23, 11 and 17) into and out of the sorption column one section. The shift may be effected by opening and shutting valves arranged in pipes connecting all of the sections with each other and with liquid streams flowing into and out of the columns. For this purpose, two way valves, three ways valves or rotary valves may be employed. The opening and shutting operations are controlled by a program timing apparatus. Thus, a simulated countercurrent flow system is provided whereby effects are obtainable similar to that achieved by a moving bed type sorption process wherein reflux streams come countercurrently into contact with the sorbent particles, and; rectification action, going hand in hand with desorption action effected in the desorption zone, ensures the continuous preparation of the sorbate product of high purity.

Sugars are solids at room temperature. Therefore, sugars have to be dissolved into an appropriate solvent in order to prepare a liquid feed mixture of sugars. One of the preferable solvents is water. Water is also an effective desorbent for fructose sorbed on zeolite particles. If water is employed as a solvent and a desorbent, a circulating stream at the bottom of the desorption zone comprises sorbent and water. If water exhibits "fractionation effect" in the rectification zone, the cycle mode as illustrated in FIG. 1, in which the circulating liquid stream is not interrupted between the desorption zone and the rectification zone, is advantageous. However, such cycle mode requires installation of a pump on the circulating line at a position between certain neighbouring sections, by which pump the liquid stream is forced to circulate through the loop of the three zones. The flow rate of the liquid driven by a pump positioned in one of the three zones is different from that by a pump positioned in any other zone. Therefore, a complicated operation for controlling the pumping condition is required every time the shifting of the points of outlet and inlet one section is effected.

The cycle mode illustrated in FIG. 2, wherein the circulating liquid stream flowing through the three zones is interrupted at a point between the desorption and rectification zones, obviates the above described defects. The reflux stream 23, which is driven by a pump, forces the circulating stream to flow through the three zones. In this case, irrespective of the shifting operation, the flow rate of the reflux stream driven by the pump is constant and, thus, controlling of the pumping condition is not required at every shifting operation. However, interruption of the circulating liquid stream at the point between the desorption and rectification zones requires valves which are provided at points between each neighbouring section. This means that the cycle mode in FIG. 2 requires an increased number of valves compared with the cycle mode in FIG. 1. However, in a case where absorbability of the desorbent to the sorbent particles is considerably lower than that of the sorbate sugar and is close to those of the raffinate sugars, the desorbent does not exhibit the fractionation effect. Therefore, in the above described case, the process as shown in FIG. 2, wherein entire circulating liquid stream is withdrawn from the bottom of the desorption zone and is treated so that the concentration of the sorbate sugar is enhanced and then is flown into the rectification zone as a reflux stream, is advantageous compared with the mode as shown in FIG. 1.

In the cycle mode shown in FIG. 2, the desorption effluent 13 contains a sorbate product (selectively sorbed component) at an extremely high concentration at the time immediately after the shifting of the points of the outlets and inlets, because only the liquid occupying the void spaces among the sorbent particles is pushed out in accordance with piston flow. However, at the time the liquid occupying the void spaces is completely removed, a desorption effluent, containing both the product selectively sorbed on the sorbent particle and desorbent, begins to flow out and the concentration of desorbent in the effluent increases with the lapse of time. In this respect, it is advantageous to adopt the following procedures. That is a stream 13 of the desorption effluent flowing out from the bottom of the last section 105 of the desorption zone I during the first part of the time interval, which effluent contains sorbate product at an extremely high concentration, is not introduced into a concentration means such as evaporator 5, but into the rectification zone II as a reflux stream. When desorbent begins to increase in the desorption effluent 13 removed from the desorption zone I at the end of a certain period of time from the shifting of the outlets and inlets, the desorption effluent is introduced into the evaporator 5 and the sorbate fraction from the evaporator is divided into two portions. One portion 15 is withdrawn as a product and the other portion 16 is circulated to the top of the rectification zone 2 as a reflux stream.

Adoption of the cycle mode illustrated in FIG. 1 or FIG. 2 should be decided on after a decision is made on the combination of sorbate, raffinate and desorbent and the shifting operation to be required.

Figures 3, 3A:
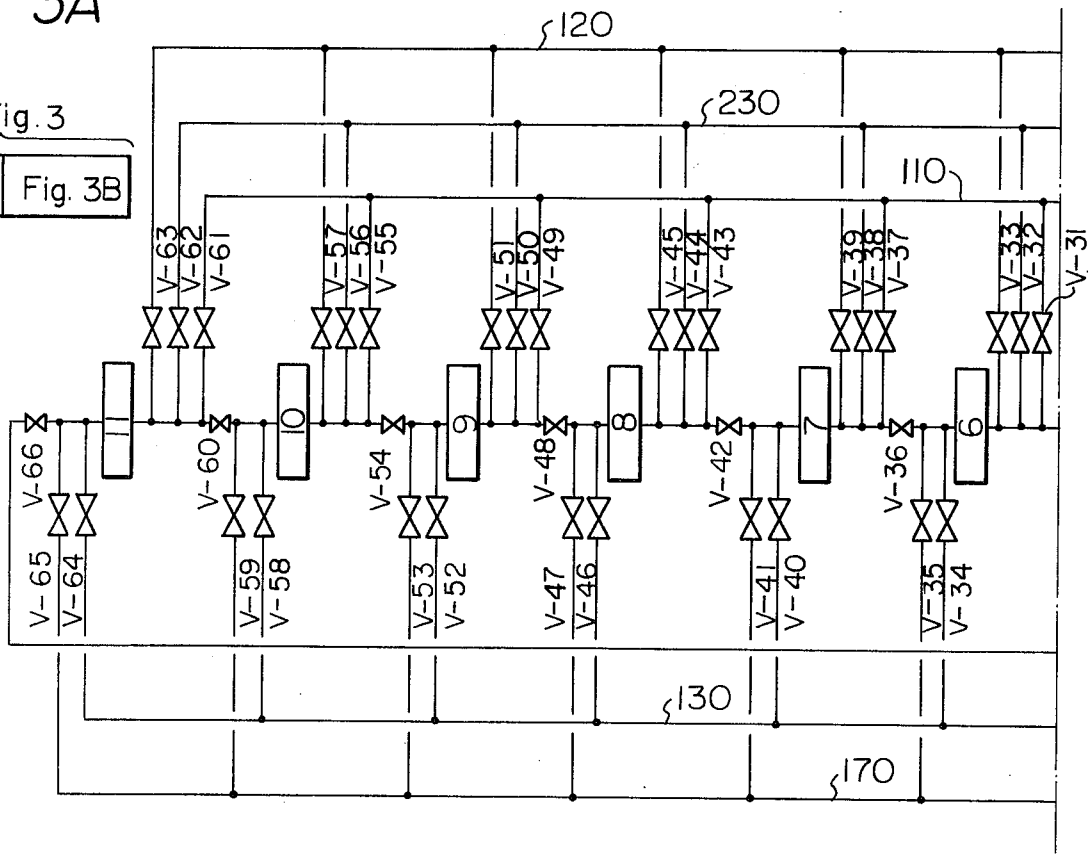
FIG. 3 schematically shows the mode as illustrated in FIG. 2 in detail.
Figure 3B:
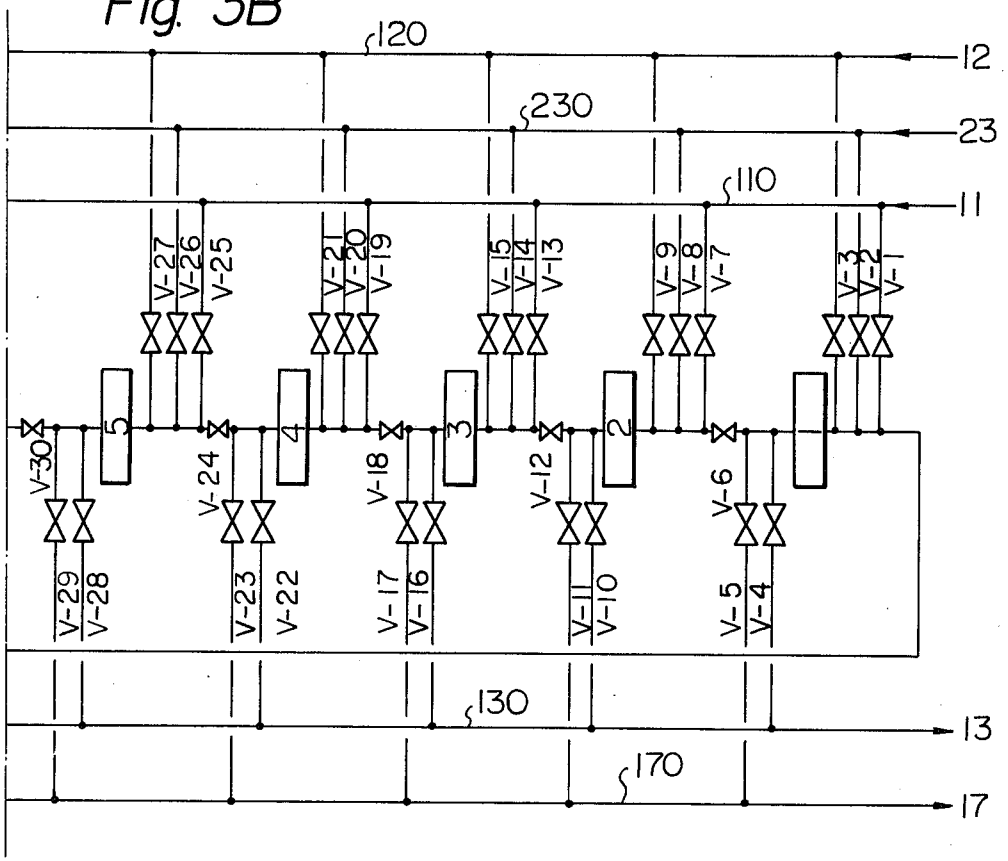
Figure 4A:
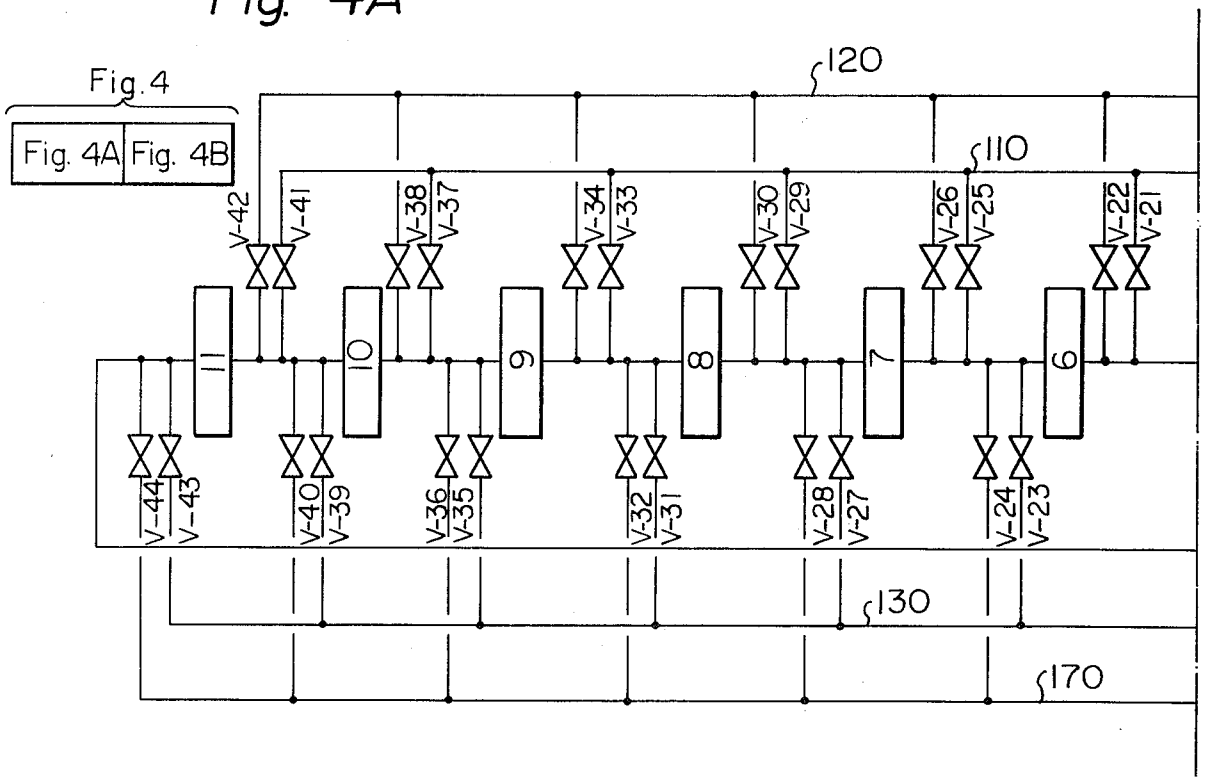
FIG. 4 schematically shows the mode as illustrated in FIG. 1 in detail.
Figure 4B:
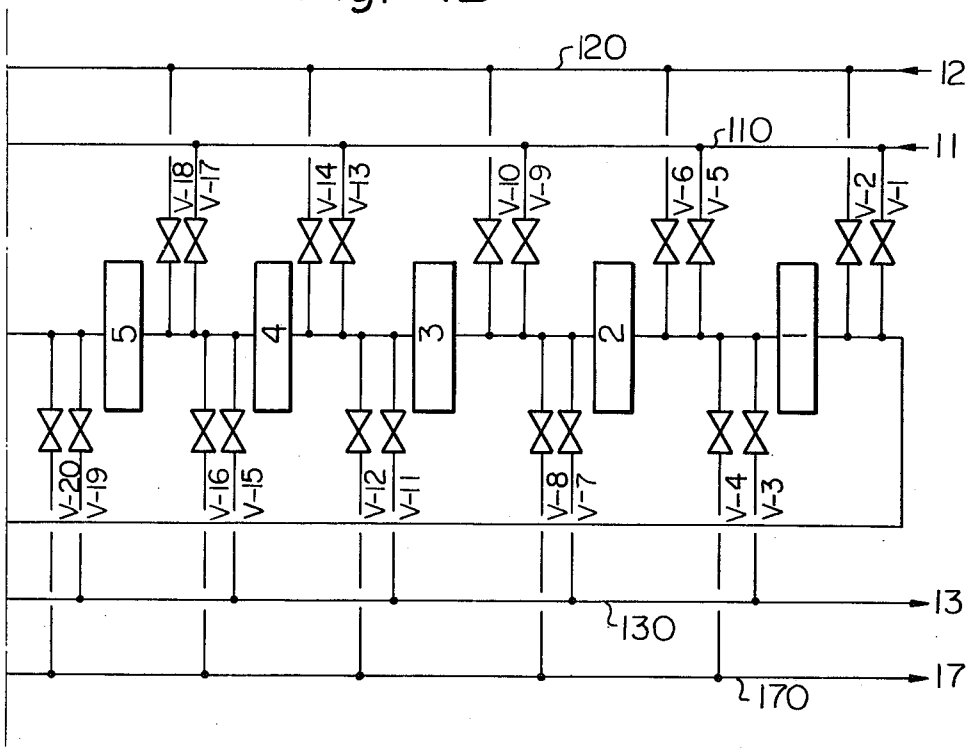

With respect to the simulated countercurrent flow system of the present invention, it is important to note the following. The simulated countercurrent flow system requires that each section be provided upstream therefrom with at least three pipe for the liquid feed mixture, the reflux stream and the desorbent as shown in FIGS. 3 and 4. Each pipe has a valve positioned at a point spaced a substantial distance from the section. Therefore, when the valve is shut, the liquid will possibly remain in the portion of the pipe between the valve and the section. Such remaining liquid is introduced into the section after the shifting is completed. This phenomenon causes the reflux stream to be contaminated with the remaining feed mixture and, thus, the purity of the sorbate product is reduced.

Further, each section is provided, downstream therefrom, with two pipes for the desorption effluent and the raffinate effluent, and each pipe has a valve positioned at a point spaced a substantial distance from the section as shown in FIGS. 3 and 4. Therefore, the desorption effluent may be contaminated with the raffinate effluent remaining in the portion of the pipe between the valve and the section after the valve for the raffinate effluent is shut.

To prevent such contamination as described above, it is preferable to wash the pipe portion where the liquid remains with an additional desorbent stream immediately after the valve is shut, that is, just after the shifting of the outlet and inlet is effected. Alternatively, it is desirable to arrange piping including valves positioned as close as possible to the sections.

It is desirable to provide a liquid stream of a piston flow through beds of the solid sorbent particles in the sorption column for increasing the sorption rate in the sorption-separation process. To attain the piston flow, it is preferable to utilize sorbent particles having a small size and reduce the diameter of the column, thereby to increase the linear velocity of liquid. To maintain the piston flow, it is effective to attain a uniform distribution of the liquid feed flow at an entrance portion of the sorption column. To attain the uniform distribution, it is preferable to employ distributing pipes or plates. If the size of the sorbent particles is excessively small, the pressure drop of the stream through the sorption column will be increased. A preferred size of the sorbent particles is within the range of from 0.05 to 5 mm, and a preferred linear velocity of the liquid based on the empty column is within the range of from 0.05 to 20 cm/sec.

With an increase of temperature, the sorption rate also increases, but the sorption capacity decreases. Further, a high temperature causes undesirable side-reactions of the sugars. In consideration of these factors, a suitable temperature of the liquid is within the range of from 0° to 100° C.

In order to ensure a high degree of purity of the sorbate product, in accordance with the process of the present invention, the sorbate component is allowed to flow back, as a reflux stream with a flow rate exceeding the minimum reflux ratio, to the rectification zone, whereby the component flowing downstream countercurrently contacts the sorbent particles flowing upstream in the rectification zone. The term "reflux ratio" as used herein means the ratio of the flow rate of the sorbate product allowed to flow back to the rectification zone to the entire sorbate product withdrawn from the system.

A change, wherein the number of sections is increased and the volume of sorbent charged into each section is decreased, so as to keep the sorption capacity constant, and the interval of time between the shifts of the introduction and withdrawal points is shortened, has the advantage that total amounts of sorbent required may be reduced, but the disadvantage that the number of valves required increases with the increased number of the sections. Further, the shortening of the interval between shifts raises a problem that the mechanical structure of valves does not allow smooth shifting. On the other hand, another modification, wherein the volume of sorbent to be charged into each section is increased and the interval between shifts is prolonged, requires a great amount of sorbent. Therefore, the process conditions should be suitably determined taking all of the above factors into consideration. An interval of 0.5 to 10 minutes between the shifts is generally preferred. The number of the sections should be determined depending upon the adsorption equilibrium, reflux ratio, flow rate of desorbent, interval between shifts, etc., and, in general, is preferably 5 to 40.

The process of the present invention is applicable to all methods of sorption-separation relying upon solid sorbent particles having a capacity of selectively sorbing one of the components of a feed sugar mixture in liquid phase. However, the process of the present invention may be most preferably applied to separation of fructose from glucose which is an isomer of fructose, particularly relying upon a particular crystalline alumino-silicate sorbent. Preferable sorbents of crystalline alumino-silicate are represented by the following formula.

$(M_{2/n}O)x\cdot(Al_2O_3)y\cdot(SiO_2)z\cdot(H_2O)w$, wherein M is a cation mainly of alkali metal or alkali earth metal, n is the valence of the cation, and x, y, z and w are respectively mole numbers.

Crystalline alumino-silicates in the form of faujasite type X, Y and L, in the form of mordenite, are preferably used. The exchangeable cationic sites for the crystalline alumino-silicates represented as M in the above formula are preferably composed of the metal cations: lithium, sodium, potassium and cesium among the alkali metals, and beryllium, magnesium, calcium, strontium and barium among the alkali earth metals. The latter alkali earth metals are most favorably utilized as the cation.

Water is most preferable as a solvent for sugars, from the point of view of solubility and safety. In this case, alcohol or another solvent can be added to a certain extent, if necessary or desired.

The mixture of sugars that may be used as the feed mixture essentially contains fructose and glucose, and may contain minor amounts of starch, oligosaccharides or other sugars in addition to the fructose and the glucose. The preferred feed mixtures are fructose syrup obtained from isomerization of glucose by enzyme-catalyzed reaction, or base-catalyzed reaction, and those obtained from sucrose by acid-hydrolysis or enzyme-catalyzed reaction. The above fructose-containing glucose isomerized syrup may contain oligosaccharides including disaccharides and contaminating substances, or may contain maltose, mannose and/or psicose as contaminating substances.

Selection of a suitable desorbent is very important, because it not only affects the cost of separation, but also, the safety of the product. Particularly the following factors should be adequatly considered. A preferable desorbent has the capabilities of dissolving sugars, of being sorbed on the sorbent at a high sorption rate and of desorbing materials sorbed on the sorbent. If a weak desorbent is employed, the amounts of the desorbent necessary to desorb the sorbate sugar is increased, and a concentration of the desorbent in the product obtained is increased. In this case, the cost incurred in separation of the product of fructose from the desorbent is increased. On the other hand, employment of a very strong desorbent is disadvantageous, because a great amount of the desorbent remains on the sorbent when the sorbate component is sorbed and, thus, the concentration of the desorbent in the product obtained is increased. Further in this case, the sorption capacity of the sorbate component is reduced and, thus, an increased amount of the sorbent is required. A desirable desorbent has an advantage that a simple separation process attains sufficient removal of the desorbent from the product obtained.

In consideration of the above factors, water itself is not only a preferable solvent for sugars, but also, an ideal desorbent for separation of fructose from a mixture of fructose, glucose and contaminating substances, by the continuous sorption-separation process of the present invention.

The process of the present invention is further explained in the following examples wherein the separation of fructose from glucose is carried out continuously.

EXAMPLE 1

Employed was an arrangement as shown in FIG. 3, in accordance with the cycle mode illustrated in FIG. 2. Referring to FIG. 3, the arrangement involved piping with 66 valves and eleven vertical columns, 1, 2, 3, 4, 5, 6, 7, 8, 9, 10 and 11, serially interconnected. All the columns were divided into three zones: desorption, rectification and sorption zones. Each zone was comprised of 5, 2 and 4 columns, respectively. Each column had an inner diameter of 25 mm and a height of 1.5 m and was packed with particles of barium zeolite in the form of Y type, to a height of 1.35 m from the bottom, which spherical particles had of a size of 0.5 mm. Copper particles having a size of 0.5 mm were also packed into each column in the remaining vacant space, that is, to a height of 0.15 m from the top of the zeolite layer. The total amount of the zeolite particles packed in the column was 4.5 kg. All of the pipes and the valves had an inner diameter of 2 mm, and the distance between the column and the valve for shifting the points of introducing and withdrawing the liquid streams into and from the columns was short enough to prevent contamination of the liquid stream.

Opening and shutting of all the valves was effected by a program timing apparatus. The time required for opening or shutting the valves was less than one second.

A feed mixture was employed which was an aqueous solution of 7% by weight of a sugar mixture consisting of 57.5% by weight of glucose and 42.5% by weight of fructose. The feed mixture was continuously fed, at the room temperature, through a pipe 110 at a flow rate of 1.5 kg/hr. Another aqueous solution of 1.0 wt % of the sugar mixture, at room temperature, was continuously fed as a reflux stream through a pipe 230 at a flow rate of 8.5 kg/hr. Water was continuously fed, at the room temperature, as a desorbent through a pipe 120 at a flow rate of 2.9 kg/hr.

Prior to the feeding of the three liquids, 15 valves, indicated by the numerical references V-3, 6, 12, 18, 24, 28, 32, 36, 42, 43, 48, 53, 54, 60, and 66, were opened, and the remaining 51 valves were shut. Six minutes after the feeding commenced, 15 valves with the reference numerals V-6, 9, 12, 18, 24, 30, 34, 38, 42, 48, 49, 54, 59, 60 and 66 were opened, and simultanteously, the remaining 51 valves were shut, whereby all the points of introduction and withdrawal of the liquid streams were shifted by one section, that is one column. Similarly, all of the introduction and withdrawal points were simultaneously shifted at intervals of six minutes. The valves V-6, 12, 18, 24, 30, 36, 42, 48, 54, 60, and 66, each correspond to the valve 8 shown in FIG. 2.

Raffinate effluent was continuously withdrawn at a flow rate of 0.2 kg/hr through a pipe 170. In this withdrawn effluent, the sugar mixture was present in a concentration of 45 wt % and water was present in a concentration of 55 wt %. The sugar mixture contained about 3% of fructose.

Desorption effluent was withdrawn at a flow rate of 12.7 kg/hr through a pipe 130. In the withdrawn effluent, fructose was present in a concentration of 1.0 wt % and water was present in a concentration of 99.0 wt %. There was practically no glucose in the desorption effluent.

EXAMPLE 2

Employed was an arrangement as shown in FIG. 4 in accordance with the cycle mode illustrated in FIG. 1.

Referring to FIG. 4, the arrangement involved piping with 44 valves and eleven vertical columns, 1, 2, 3, 4, 5, 6, 7, 8, 9, 10 and 11, serially interconnected. All of the columns were divided into three zones: desorption zone of 5 columns, rectification zone of 2 columns and sorption zone of 4 columns. The dimensions of each column, kind, size and amount of packed particles, and program timing apparatus were the same as those of Example 1.

A feed mixture with a composition the same as that of Example 1 was fed, at the room temperature and a flow rate of 1.5 kg/hr, through a pipe 110. Water as desorbent was fed, at room temperature and a flow rate of 2.9 kg/hr, through a pipe 120.

Prior to the feeding of the two liquids, 4 valves, indicated by the reference numerals V-2, 19, 29, and 36 were opened, and the remaining 40 valves were shut. Six minutes after the feeding commenced, 4 valves with the reference numerals V-6, 23, 33 and 40 were opened, and simultaneously, the other 40 valves were shut, whereby all of the points of introduction and withdrawal of the liquid streams were shifted by one column. Similarly, all of the introduction and withdrawal points were simultaneously shifted at intervals of six minutes.

Raffinate effluent was continuously withdrawn at a flow rate of 0.2 kg/hr through a pipe 170. The withdrawn effluent contained the sugar mixture in a concentration of 45 wt % and water in a concentration of 55 wt %. In the sugar mixture, fructose was present in a concentration of about 3%.

Desorption effluent was continuously withdrawn at a flow rate of 4.2 kg/hr through a pipe 130. In the withdrawn effluent, the concentrations of fructose and water were 1.0 wt % and 99.0 wt %, respectively. There was practically no glucose in the effluent. The flow rate of the circulating fluid stream in the rectification zone was about 8.5 kg/hr.

What we claim is:

1. A process for continuously separating, in liquid phase, fructose from a liquid feed mixture of sugars containing essentially fructose and glucose, fructose being selectively sorbed by contact with solid sorbent particles of crystalline alumino-silicate or zeolite, utilizing a simulated counter-current flow system, wherein liquid streams are allowed to flow through three serially and circularly interconnected zones including a desorption zone, a rectification zone and a sorption zone, each zone being divided into a plurality of serially interconnected sections, each section being packed with a mass of said solid sorbent particles, comprising the steps of introducing said liquid feed mixture into the first section of said sorption zone, introducing water as a desorbent into the first section of said desorption zone, withdrawing a portion of a desorption effluent comprising the sorbate and the desorbent from the last section of said desorption zone for obtaining a product of fructose, withdrawing a portion of a raffinate effluent comprising less sorbed sugars and the desorbent from a point such that at least one section of said sorption zone remains downstream therefrom, and all of the points of introducing and withdrawing said liquid streams into and from said sections are simultaneously shifted one section at a time at predetermined intervals of time, in a downstream direction, while maintaining the same order of continuity and the same spatial relationship between said points, and circulating said liquid streams flowing in said three zones without any interruption of flow between said desorption zone and said rectification zone.

2. A process for continuous separation of fructose in accordance with claim 1, wherein said solid sorbent particles are of zeolite in the form of faujasite type X, Y or L.

3. A process for continuous separation of fructose in accordance with claim 1, wherein the size of said solid sorbent particles is in the range of from 0.05 to 5 mm, the number of said sections is in the range of from 5 to 40, the linear velocity of liquid based on the empty column in each section is within the range of from 0.05 to 20 cm/sec and the interval of time between the shifts is in the range of from 0.5 to 10 minutes.

* * * * *

Notice of Adverse Decision in Interference

In Interference No. 100,551, involving Patent No. 4,157,267, H. Odawara, M. Ohno, T. Yamazaki and M. Kanaoka, CONTINUOUS SEPARATION OF FRUCTOSE FROM A MIXTURE OF SUGARS, final judgment adverse to the patentees was rendered November 13, 1981, as to claims 1-3.

[*Official Gazette February 23, 1982.*]